US005979583A

United States Patent [19]

Amino et al.

[11] Patent Number: 5,979,583

[45] Date of Patent: Nov. 9, 1999

[54] MUFFLER FOR MOTORCYCLE

[75] Inventors: Hideo Amino; Kazuaki Furukawa; Shigeo Iijima, all of Saitama, Japan

[73] Assignee: Honda Giken Kogyo Kabushiki Kaisha, Tokyo, Japan

[21] Appl. No.: 08/900,129

[22] Filed: Jul. 25, 1997

[30] Foreign Application Priority Data

Jul. 25, 1996 [JP] Japan ..... 8-196216

[51] Int. Cl.[6] ..... B62D 61/02

[52] U.S. Cl. ..... 180/219; 181/238; 181/251

[58] Field of Search ..... 180/219–231; 181/238, 228, 247, 248, 249, 251, 255, 264, 269, 272, 275

[56] References Cited

U.S. PATENT DOCUMENTS 4,203,502 5/1980 Strader ..... 181/238

5,608,194 3/1997 Okazaki ..... 181/228

FOREIGN PATENT DOCUMENTS 8-28244 1/1996 Japan .

*Primary Examiner*—Robert J. Oberleitner
*Assistant Examiner*—C. T. Bartz

[57] ABSTRACT

A muffler is connected to a pair of exhaust pipes extending from each cylinder of a multi-cylinder engine. The muffler assures easier assembling work and provides independent exhaust sound for each cylinder. The muffler includes a forward and a rearward expansion chamber within the inside thereof. The expansion chambers are separated in the longitudinal direction by a separation wall extending across the muffler. The exhaust pipe connected to the forward cylinder of a V-type two-cylinder engine is inserted into the forward expansion chamber, while the exhaust pipe connected to the rear cylinder is inserted into the rearward expansion chamber.

20 Claims, 3 Drawing Sheets

MUFFLER FOR MOTORCYCLE

BACKGROUND OF THE INVENTION

1. Field of the Invention

The present invention relates to a muffler for a motorcycle, and more particularly, to a muffler connected to the downstream side of a plurality of exhaust pipes connected to each cylinder of a multi-cylinder engine.

2. Description of the Background Art

A muffler for a motorcycle is known which is provided with an expansion chamber to which a plurality of exhaust pipes connected to each cylinder of the multi-cylinder engine are inserted. The muffler is provided with separating walls extending in the longitudinal direction to form a plurality of side-by-side individual expansion chambers so that the downstream end portion of each exhaust pipe can be inserted into individual expansion chambers (Japanese Patent Laid-Open No. HEI 8-28244). The known muffler combines a plurality of mufflers within one muffler housing. Use of the known muffler explained above allows the individual exhaust sound for each cylinder to be obtained by using only one muffler.

SUMMARY OF THE INVENTION

In the case of manufacturing the known muffler, the separating walls are provided in the muffler by welding the separating walls in the longitudinal direction within the muffler. Welding is required in many areas continuously or intermittently along the entire length of the separating walls. Such welding process is not always easy, when considering the dimension in the longitudinal direction of the muffler.

It is therefore an object of the present invention to provide a muffler which is connected to the downstream side of the exhaust pipe which is coupled to each cylinder of the multi-cylinder motorcycle engine, wherein a plurality of expansion chambers separated in the longitudinal direction of the muffler are formed by separating walls extending across the muffler. Downstream end portions of each exhaust pipe are inserted into individual expansion chambers so that flow of exhaust gas from the individual cylinders do not interfere with each other.

When the separating walls are provided in the longitudinal direction of the known muffler, the fitting processes for installation of the separating walls must be performed along the entire length of muffler. In the case of the separating walls extending across the muffler of the present invention, the fitting work position is limited only to the predetermined positions in the longitudinal direction along the muffler. The separating walls can be fitted easily and the number of assembling steps to produce the muffler can be reduced. Moreover, since the downstream end portion of each exhaust pipe is individually connected to a separate expansion chamber, flow of exhaust gas from the individual cylinders do not interfere with each other, and independent exhaust sound can be obtained for each cylinder.

Because the separating wall provided in the longitudinal direction of the known muffler also serves as a side wall of the adjacent expansion chamber, it is difficult to shift the position of the upstream end portion of one expansion chamber in the longitudinal direction of the muffler with respect to the position of the other expansion chamber. However, in the muffler of the present invention, since the expansion chambers are formed by separating the space within the muffler with the separating walls extending across the muffler in the transverse direction, each expansion chamber is located at a position forward or rearward in the longitudinal direction of the muffler.

The position of each expansion chamber is determined depending on the fitting position of the separating wall. Accordingly, when the downstream end portion of the exhaust pipe connected to the forward cylinder of the V-type engine is inserted into the forward expansion chamber of the muffler, and the downstream end portion of the exhaust pipe connected to the downstream end portion of the exhaust pipe connected to the rear cylinder is inserted into the rearward expansion chamber, positional deviation of the upstream end portions of both exhaust pipes is canceled, and the exhaust pipe length becomes equal, or a difference in the length may be reduced. When the difference in the length of the exhaust pipes becomes small, the exhaust characteristics may be further made uniform.

Moreover, since a plurality of expansion chambers are formed by providing the separation walls extending across the muffler, the expansion chambers in the muffler can be formed in equal volumes by adjusting the fitting positions of the separation walls, and equal volume will provide more uniform exhaust characteristics.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, a preferred embodiment of the present invention will be described with reference to the drawings.

Figure 1:
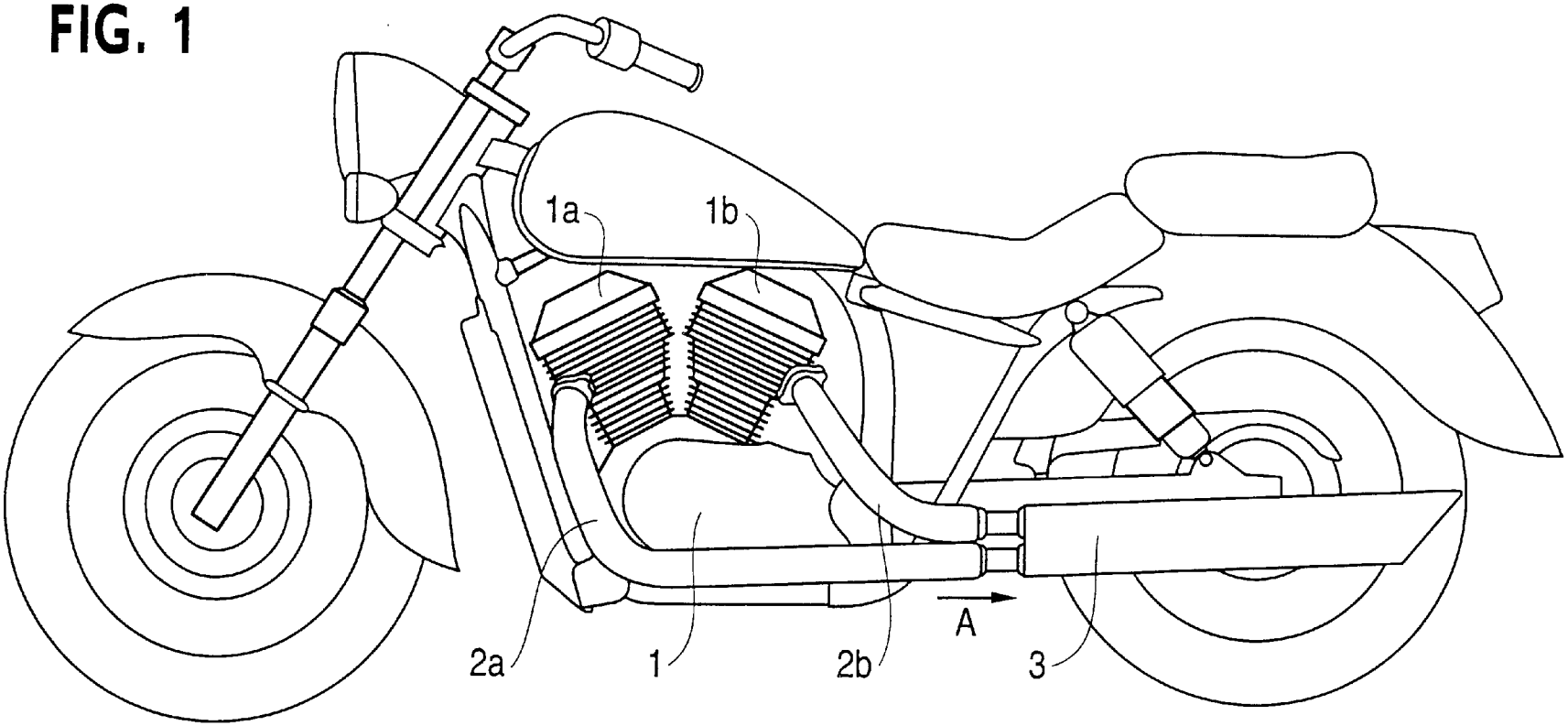
FIG. 1 is a side view showing a motorcycle having a V-type engine and a muffler according to the present invention.
Figure 2:
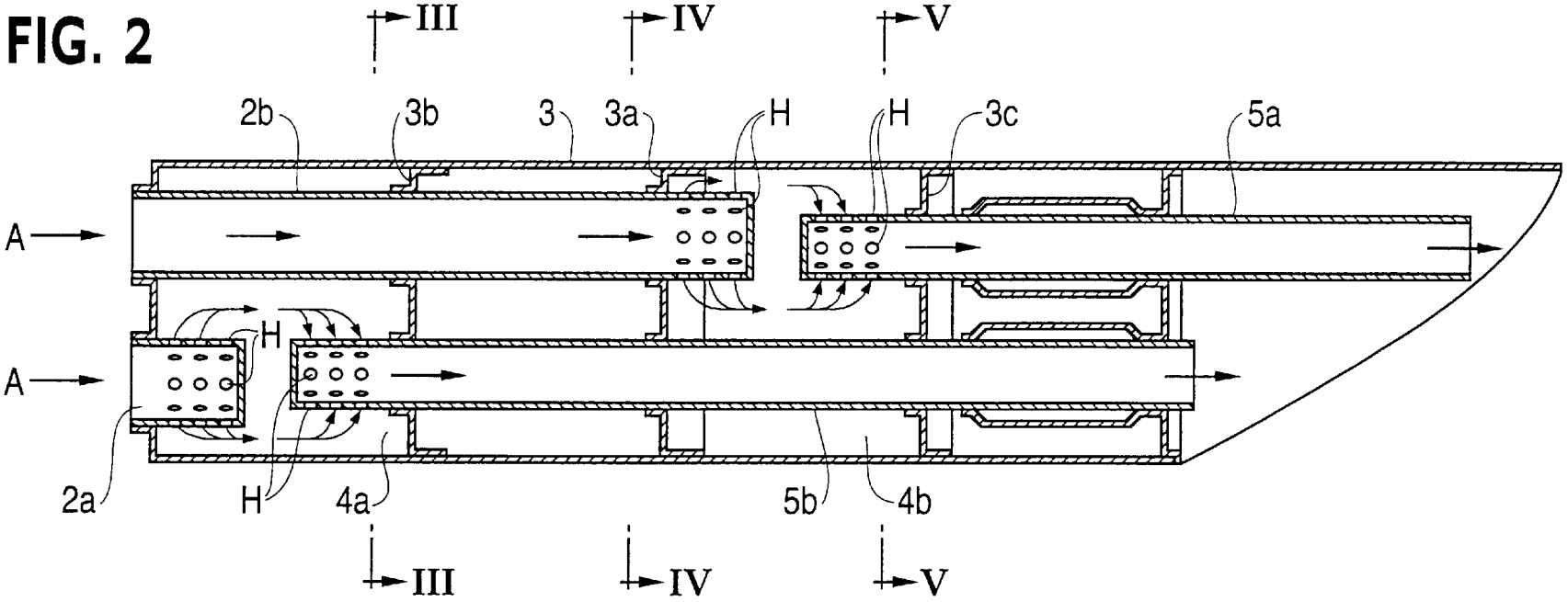
FIG. 2 is a side view showing the internal structure of the muffler shown in FIG. 1.
Figure 3:
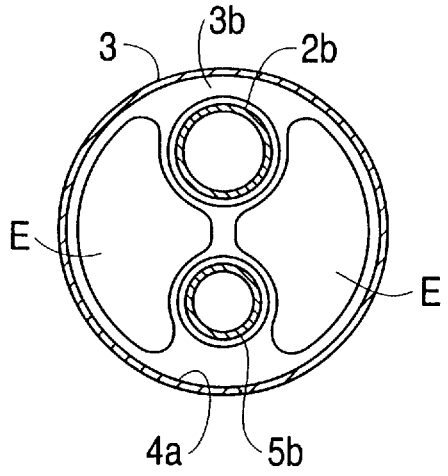
FIG. 3 is a cross-sectional view taken along line III—III of FIG. 2.
Figure 4:
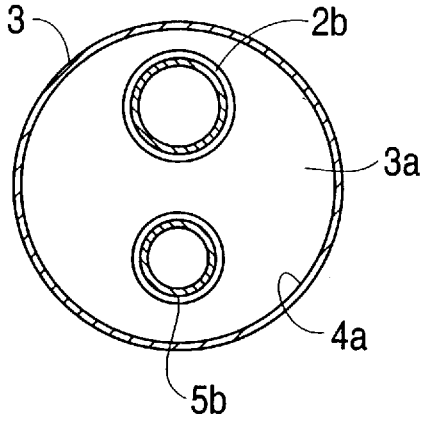
FIG. 4 is a cross-sectional view taken along line IV—IV of FIG. 2.
Figure 5:
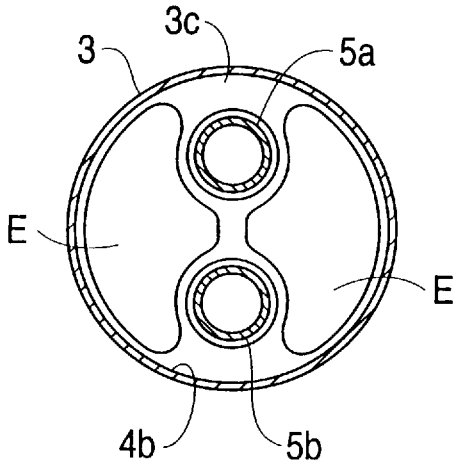
FIG. 5 is a cross-sectional view taken along line V—V of FIG. 2.

With reference to FIG. 1, reference numeral 1 denotes a V-type two-cylinder engine installed on a motorcycle. The upstream end portion of a forward exhaust pipe 2*a* is connected to a forward cylinder 1*a* of the V-type two-cylinder engine 1, and the upstream end portion of a rearward exhaust pipe 2*b* is connected to the rearward cylinder 1*b* of the engine 1. The exhaust pipes 2*a*, 2*b* are coupled with the muffler 3 attached almost horizontally to the rear side of the motorcycle. The letter "A" indicates the flowing direction of exhaust gas.

With reference to FIG. 2 to FIG. 5, a separating wall 3*a* extending across the muffler 3 is welded within the muffler 3. Thereby, a forward expansion chamber 4*a* and a rearward expansion chamber 4*b* are formed by separating the inside space of the muffler 3 with the separating wall 3*a*. The downstream end portion of the forward exhaust pipe 2*a* is inserted into the forward expansion chamber 4*a*, and the downstream end portion of the rearward exhaust pipe 2*b* is inserted into the rearward expansion chamber 4*b*.

A supporting member 3*b* for supporting the exhaust pipe 2*b* and a tail pipe 5*b* is mounted in the forward expansion chamber 4*a*. A supporting member 3*c* for supporting the tail pipe 5*b* and a further tail pipe 5*a* is provided within the rearward expansion chamber 4*b*. The supporting members 3*b*, 3*c* are each provided with two approximately sector-shaped holes E for allowing exhaust gases to pass therethrough. The holes E are located in the supporting members 3*b*, 3*c* in such a manner to avoid the engaging portions with the exhaust pipe 2*b* and the tail pipes 5*a*, 5*b*. The front side of the separating wall 3*a* functions as a rear wall of the forward expansion chamber 4*a*, while the rear side of the separating wall 3*a* functions as a front wall of the rearward expansion chamber 4*b*.

The exhaust pipes 2*a*, 2*b* are respectively provided with a plurality of small holes H around the external circumference of the pipes near the closed downstream end portion of the pipes 2*a*, 2*b*. The exhaust gas is exhausted into the expansion chambers 4*a*, 4*b* through such small holes H. Moreover, the respective expansion chambers 4*a*, 4*b* allow insertion of the closed upstream end portions of the tail pipes 5*a*, 5*b*. The exhaust gas flows into the tail pipes 5*a*, 5*b* through a plurality of small holes H formed at the external circumference of the pipes near the upstream end portion of the tail pipes 5*a*, 5*b*. Thereafter, the exhaust gas is released to the atmosphere from the downstream end portion of the tail pipes 5*a*, 5*b*.

According to the preferred embodiment of the present invention, in the case where both exhaust pipes 2*a*, 2*b* are connected to the same muffler 3, the downstream end position of the rearward exhaust pipe 2*b* can be shifted rearward from the downstream end portion of the forward exhaust pipe, and thereby forward and rearward deviation of the upstream end position of both exhaust pipes can be canceled to make the positional difference of both exhaust pipes 2*a*, 2*b* small. When the separating wall extending across the muffler 3 is provided as in the muffler 3 of the preferred embodiment, the longitudinal to lateral ratio of the expansion chamber size becomes smaller than that when the separation wall is provided in the longitudinal direction as in the known muffler. Moreover, since the influence on the exhaust characteristic due to a difference in the insertion lengths of the exhaust pipes becomes smaller, a difference in length of the exhaust pipes can be made smaller by adjusting the insertion length of the exhaust pipes 2*a*, 2*b* into the expansion chambers 4*a*, 4*b*.

Although both exhaust pipes 2*a*, 2*b* are connected to the same muffler 3, the exhaust gas from both exhaust pipes 2*a*, 2*b* is respectively released to the atmosphere through different routes. Accordingly, mutual interference by mixing of exhaust gas can be eliminated, and independent exhaust sound can be assured for each cylinder 1*a*, 1*b*.

A structure for expanding the exhaust gas from each cylinder within the individual expansion chambers may be produced where the expansion chambers are mutually communicated with a small pipe, and a communication degree is adjusted to adjust the exhaust characteristic such as the exhaust sound of the gas. In some cases, a communicating pipe is required when the expansion chambers communicating with each other are formed in different mufflers. However, in the preferred embodiment of the present invention, since both expansion chambers 4*a*, 4*b* are provided adjacently by separation of the separating wall 3*a*, the separating wall 3*a* may be provided with a communicating hole (not provided) to communicate with both expansion chambers, and the exhaust characteristic can be adjusted by merely adjusting a size of the communicating hole.

The muffler 3 shown in the figures is provided with the expansion chambers 4*a*, 4*b* to which the downstream end portions of the exhaust pipes 2*a*, 2*b* are inserted. When the separation wall 3*a* is fitted in the intermediate part of the muffler 3 in the longitudinal direction, the two expansion chambers 4*a*, 4*b* have equal volume. But, even in the case where a plurality of exhaust routes are formed within the same muffler, having the first expansion chamber to which the exhaust pipe is inserted and a second expansion chamber which expands the exhaust gas expanded in the first expansion chamber, a plurality of the first expansion chambers having equal volume may be arranged at the forward or rearward positions within the muffler in the longitudinal direction, and a plurality of second expansion chambers having equal volume may also be arranged at the forward or rearward positions within the muffler in the longitudinal direction.

As described previously, according to the present invention, since the separation wall can be provided easily, a muffler can be assembled easily, assuring independent exhaust sound for each cylinder.

Moreover, since the expansion chambers are formed at the forward and rearward positions of the separating wall by separating the space within the muffler using the separation wall fitted transversely within the muffler, the exhaust pipe connected to the forward cylinder of the V-type engine is inserted into the forward expansion chamber, while the exhaust pipe connected to the rear cylinder is inserted into the rearward expansion chamber. Thereby, deviation of the upstream end positions can be canceled within the same muffler, and a difference in length of the exhaust pipes can be reduced to provide uniform exhaust characteristics of the exhaust route corresponding to each cylinder.

Moreover, the volume of each expansion chamber can be equalized by determining the fitting position of the separation wall extending across the muffler, and thereby the exhaust characteristic can be approximated to a uniform degree.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A muffler for a motorcycle, said muffler being connectable to downstream ends of at least a pair of exhaust pipes respectively connected to each cylinder of a multi-cylinder engine mounted on said motorcycle, said muffler comprising:

a plurality of separate expansion chambers formed in said muffler by separating said muffler in a longitudinal direction of the muffler with a separating wall extending transversely across said muffler, wherein the downstream end of each exhaust pipe is adapted to be respectively insertable into an individual one of said expansion chambers so that the exhaust gasses flowing from each cylinder do not interfere with one another, and wherein a downstream end of a front exhaust pipe connected to a front cylinder of the engine is adapted to be inserted into a front one of the expansion chambers, and a downstream end of a rear exhaust pipe connected to a rear cylinder of the engine is adapted to be inserted into a rear one of the expansion chambers which is located rearwardly of the front one of the expansion chambers.

2. The muffler as set forth in claim 1, wherein each of said plurality of separate expansion chambers has approximately the same physical volume.

3. A muffler comprising:

an outer housing having a first end wall and a second end wall;

a separating wall located within said housing and between said first end wall and said second end wall, said separating wall dividing said housing into a first expansion chamber and a second expansion chamber;

a first pipe extending through said first end wall and terminating in said first expansion chamber; and a second pipe extending through said first end wall and said separating wall and terminating in said second expansion chamber.

4. The muffler as set forth in claim 3, wherein said first pipe is connectable to a first exhaust pipe extending from a first cylinder of an internal combustion engine, and said second pipe is connectable to a second exhaust pipe extending from a second cylinder of said engine.

5. The muffler as set forth in claim 3, further comprising a tail pipe opening to the second expansion chamber and extending outside of the muffler through the second end wall.

6. The muffler as set forth in claim 3, wherein at least one of said first and second pipes has a closed end and a plurality of holes located in the outer wall of the pipe adjacent the end thereof for allowing exhaust gasses to pass therethrough.

7. The muffler as set forth in claim 3, further comprising a first tail pipe opening to the first expansion chamber and extending outside of the muffler through the second end wall.

8. The muffler as set forth in claim 7, further comprising a second tail pipe opening to the second expansion chamber and extending outside of the muffler through the second end wall.

9. The muffler as set forth in claim 8, wherein at least one of said tail pipes has a closed end and a plurality of holes located in the outer wall of the tail pipe adjacent the end thereof for allowing exhaust gasses to pass therethrough.

10. The muffler as set forth in claim 8, further comprising a support wall located within said second expansion chamber and extending transversely across said muffler for supporting said first tail pipe and said second tail pipe.

11. The muffler as set forth in claim 10, wherein said support wall includes at least one aperture therein for allowing exhaust gasses to freely pass therethrough.

12. The muffler as set forth in claim 7, further comprising a first support wall located within said first expansion chamber and extending transversely across said muffler for supporting said second pipe and said first tail pipe.

13. The muffler as set forth in claim 12, wherein said first support wall includes at least one aperture therein for allowing exhaust gasses to freely pass therethrough.

14. A motorcycle comprising:

a frame supported by a pair of wheels;

an engine mounted to said frame for driving at least one of said wheels, said engine having at least two cylinders arranged in a V-formation with one of said cylinders facing forwardly and the other of said cylinders facing rearwardly;

a forward exhaust pipe connected to said forwardly facing cylinder;

a rearward exhaust pipe connected to said rearwardly facing cylinder; and a muffler connected to said forward exhaust pipe and said rearward exhaust pipe, said muffler having a separation wall therein for transversely dividing said muffler into a front chamber and a rear chamber, wherein one end of said forward exhaust pipe terminates in said front chamber, and one end of said rearward exhaust pipe terminates in said rear chamber.

15. The motorcycle as set forth in claim 14, wherein said muffler further comprises a first tail pipe opening to the front chamber and extending outside of the muffler, and a second tail pipe opening to the rear chamber and extending outside of the muffler.

16. The motorcycle as set forth in claim 15, wherein at least one of said tail pipes has a closed end and a plurality of holes located in the outer wall of the tail pipe adjacent the end thereof for allowing exhaust gasses to pass therethrough.

17. The motorcycle as set forth in claim 14, wherein said muffler further includes a first support wall located within said front chamber and extending transversely across said muffler for supporting said rearward exhaust pipe and said first tail pipe.

18. The motorcycle as set forth in claim 17, wherein said muffler further includes a second support wall located within said rear chamber and extending transversely across said muffler for supporting said first tail pipe and said second tail pipe.

19. The motorcycle as set forth in claim 18, wherein one of said support walls includes at least one aperture therein for allowing exhaust gasses to freely pass therethrough.

20. The muffler as set forth in claim 3, wherein said first expansion chamber is located between said first end wall and said separating wall, and said second expansion chamber is located between said separating wall and said second end wall.

* * * * *